US008969728B2

(12) United States Patent
Dorffer et al.

(10) Patent No.: US 8,969,728 B2
(45) Date of Patent: Mar. 3, 2015

(54) SMOOTH WIRELINE

(75) Inventors: Daniel F. Dorffer, Houston, TX (US); Lawrence Charles Rose, Huntsville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 256 days.

(21) Appl. No.: 13/502,183

(22) PCT Filed: Aug. 18, 2009

(86) PCT No.: PCT/US2009/054167

§ 371 (c)(1), (2), (4) Date: Apr. 16, 2012

(87) PCT Pub. No.: WO2011/021999

PCT Pub. Date: Feb. 24, 2011

(65) Prior Publication Data

US 2012/0227481 A1 Sep. 13, 2012

(51) Int. Cl.

| | |
|---|---|
| ***H01B 5/08*** | (2006.01) |
| ***H01B 9/02*** | (2006.01) |
| ***C23C 28/02*** | (2006.01) |
| ***H01B 7/22*** | (2006.01) |
| ***D07B 1/08*** | (2006.01) |
| ***D07B 1/14*** | (2006.01) |
| *H01B 7/04* | (2006.01) |

(52) U.S. Cl.

CPC *H01B 7/226* (2013.01); *D07B 1/08* (2013.01); *D07B 1/147* (2013.01); *H01B 7/046* (2013.01)

USPC ..... 174/129 R; 174/102 R; 174/106 R; 174/108; 174/128.2; 174/133 R

(58) Field of Classification Search

CPC ..... H01B 11/1808; H01B 7/226; H01B 7/046

USPC ..... 174/102 R, 106 R, 108, 128.2, 27, 113 R, 174/129 R, 133 R

See application file for complete search history.

(56) References Cited

U.S. PATENT DOCUMENTS

| | | | | |
|---|---|---|---|---|
| 1,995,407 | A | 3/1935 | Walker | |
| 1,999,273 | A * | 4/1935 | Austin | 174/128.1 |
| 2,604,509 | A * | 7/1952 | Blanchard | 174/108 |
| 4,101,731 | A * | 7/1978 | Marancik | 174/125.1 |
| 4,131,757 | A * | 12/1978 | Felkel | 174/107 |
| 4,131,758 | A * | 12/1978 | Felkel | 174/107 |
| 4,131,759 | A * | 12/1978 | Felkel | 174/107 |
| 4,214,693 | A | 7/1980 | Smith | |
| 4,992,625 | A * | 2/1991 | Izui et al. | 174/36 |

(Continued)

OTHER PUBLICATIONS

PCT/US2009/054167 International Search Report and Written Opinion, mailed Oct. 15, 2009.

(Continued)

*Primary Examiner* — Timothy Thompson
*Assistant Examiner* — Sherman Ng
(74) *Attorney, Agent, or Firm* — Howard L. Speight

(57) ABSTRACT

A cable includes a conductor. A plurality of inner armor wires is wrapped around the conductor. At least some of the plurality of inner armor wires have non-circular and non-rectangular cross-sectional shapes. A plurality of outer armor wires are wrapped around the inner armor wires. At least some of the plurality of outer armor wires have non-circular and non-rectangular cross-sectional shapes.

20 Claims, 4 Drawing Sheets

(56) References Cited

U.S. PATENT DOCUMENTS

| | | | | |
|---|---|---|---|---|
| 5,119,344 | A | 6/1992 | Innes | |
| 5,696,352 | A * | 12/1997 | Kourimsky | 174/126.3 |
| 6,392,151 | B1 * | 5/2002 | Rafie et al. | 174/106 R |
| 7,140,435 | B2 | 11/2006 | Defretin et al. | |
| 7,170,007 | B2 | 1/2007 | Varkey et al. | |
| 7,402,753 | B2 | 7/2008 | Varkey et al. | |
| 7,479,597 | B1 * | 1/2009 | Cases et al. | 174/36 |
| 2003/0178224 | A1 * | 9/2003 | Goto | 174/133 R |
| 2004/0216913 | A1 * | 11/2004 | Wiekhorst et al. | 174/110 R |
| 2004/0256139 | A1 * | 12/2004 | Clark | 174/110 R |
| 2006/0272844 | A1 * | 12/2006 | Berghofer et al. | 174/94 R |
| 2007/0193767 | A1 | 8/2007 | Guery et al. | |
| 2007/0277996 | A1 * | 12/2007 | Caveney et al. | 174/129 R |
| 2008/0041575 | A1 * | 2/2008 | Clark et al. | 166/65.1 |
| 2008/0236867 | A1 * | 10/2008 | Varkey et al. | 174/115 |
| 2008/0289849 | A1 | 11/2008 | Varkey et al. | |

OTHER PUBLICATIONS

PCT/US2009/054167 Written Opinion, mailed Nov. 1, 2011.

R.C. Wang & W.M. McKewan, "A model for the structure of round-strand wire ropes".

* cited by examiner

SMOOTH WIRELINE

BACKGROUND

Wireline equipment used to investigate boreholes and surrounding formations are typically lowered into a well borehole using a cable. In some cases, such as in a gas well, the cable holding the wireline equipment passes through a seal at the surface. The seal allows the cable to move while maintaining gas and/or well pressure within the borehole.

DETAILED DESCRIPTION

Figure 1:
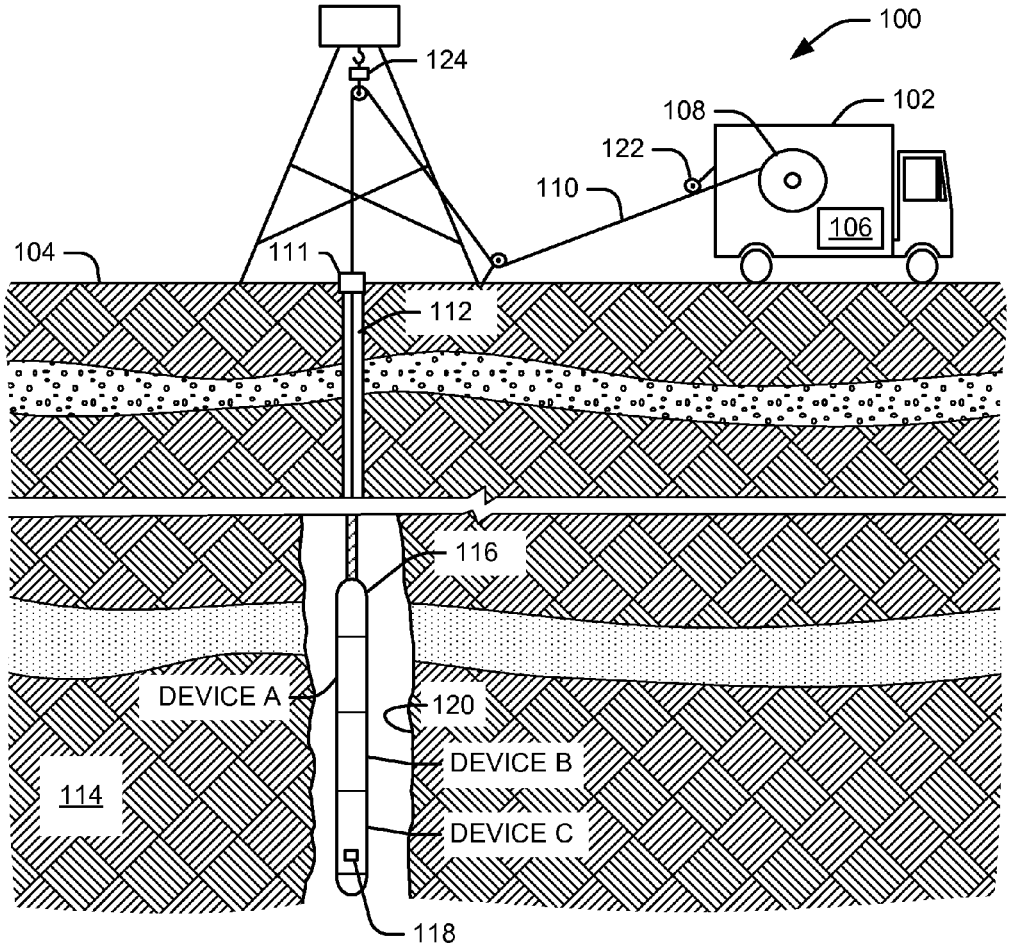
FIG. 1 is a schematic diagram of a drilling rig site showing a logging tool that is suspended from a wireline and disposed internally of a bore hole.

In one embodiment of a wireline well logging system 100 at a drilling rig site, as depicted in FIG. 1, a logging truck or skid 102 on the earth's surface 104 houses a data gathering computer 106 and a winch 108 from which a wireline cable 110 extends through a sealing apparatus 111 into a well bore 112 drilled into a hydrocarbon bearing formation 114. In one embodiment, the wireline cable 110 suspends a logging toolstring 116 within the well bore 112 to measure formation data as the logging tool 116 is raised or lowered by the wireline 110. In one embodiment, the logging toolstring 116 includes a z-axis accelerometer 118 and several devices A, B, C. In different embodiment, these devices are instruments, mechanical devices, and/or explosive devices.

In one embodiment, the wireline cable 110 not only conveys the logging toolstring 116 into the well, it also provides a link for power and communications between the surface equipment and the logging toolstring.

In one embodiment, as the logging tool 116 is raised or lowered within the well bore 112, a depth encoder 122 provides a measured depth of the extended cable. In one embodiment, a tension load cell 124 measures tension in the wireline 110 at the surface 104.

Figure 2:
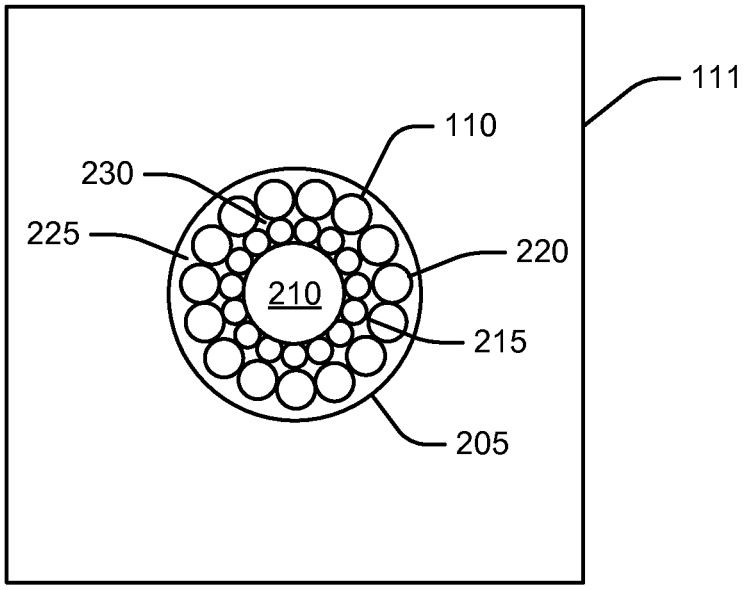
FIG. 2 (PRIOR ART)
FIG. 2 is a cross-sectional view of a cable and a seal.

A more detailed view of one embodiment of the sealing apparatus 111, shown in FIG. 2, shows the presence of an aperture 205 through which the wireline cable 110 passes. It should be noted that many details of the sealing apparatus are not shown in FIG. 2.

FIG. 2 also illustrates a prior art version of a wireline cable 111, which includes a conductor or conductors 210, a inner set of armor wires 215 (only one is referenced) and an outer set of armor wires 220 (only one is referenced). Note that the gap between the wireline cable 111 and the boundary of the aperture 205 in the sealing apparatus 111 is exaggerated for purposes of explanation.

Typically, as illustrated in FIG. 2, the wireline cable 111 is a braided cable and the inner armor wires 215 and outer armor wires 220 are round. Such a design leaves voids, e.g., such as the void 225 between the wireline cable 110 and the boundary of the aperture 205 and the void 230 between the inner set of armor wires 215 and the outer set of armor wires 220. In one embodiment, one of the goals in designing wireline systems is limiting the size of the voids because such voids are challenging to seal. Typically, such considerations limit the outside diameter of the cable that can be used under pressure. This is because, typically, as the outside diameter of the wireline cable 111 increases, the outside diameter of the outer set of armor wires 220 also increases, which also tends to increase the size of the outer voids, e.g., 225, and the inner voids, e.g. 230. Further, the braided cable design tends to increase friction with the aperture and creates environmental concerns when grease used to seal the outer voids, e.g., 225, is lost.

Figure 3:
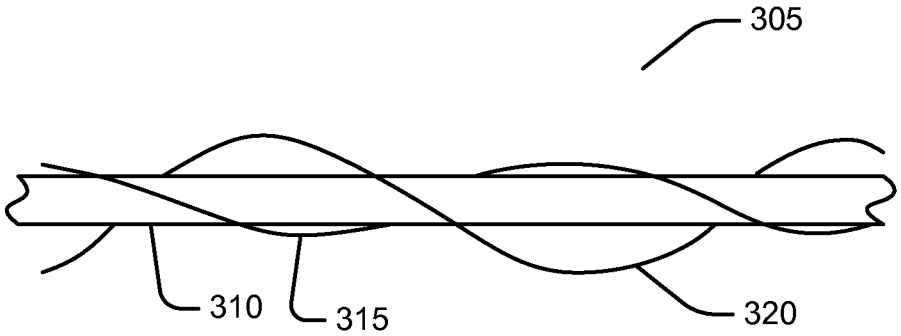
FIG. 3 is a perspective view of a cable.
Figure 4:
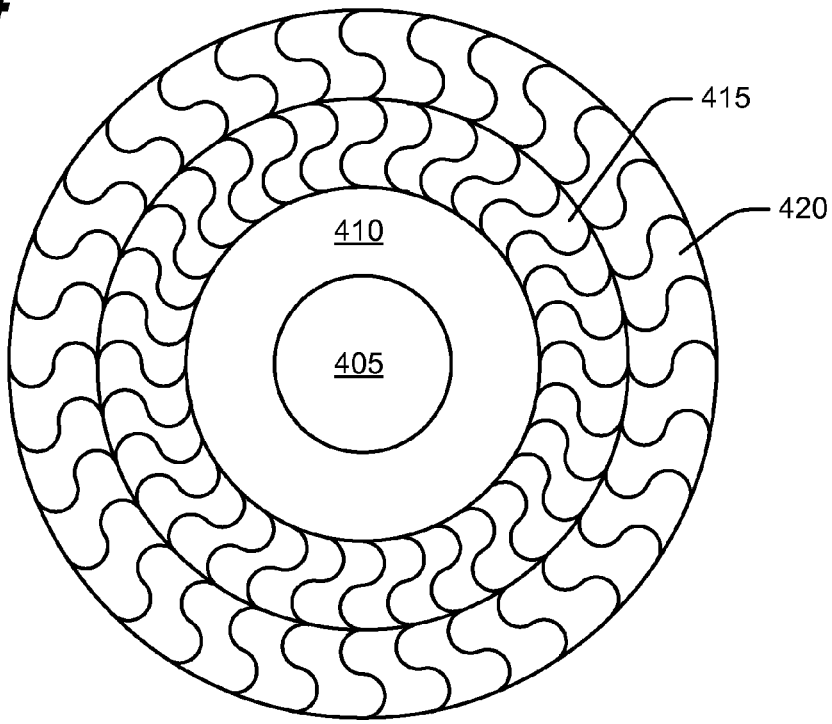
FIGS. 4 and 5 are cross-sectional views of cables.
Figure 5:
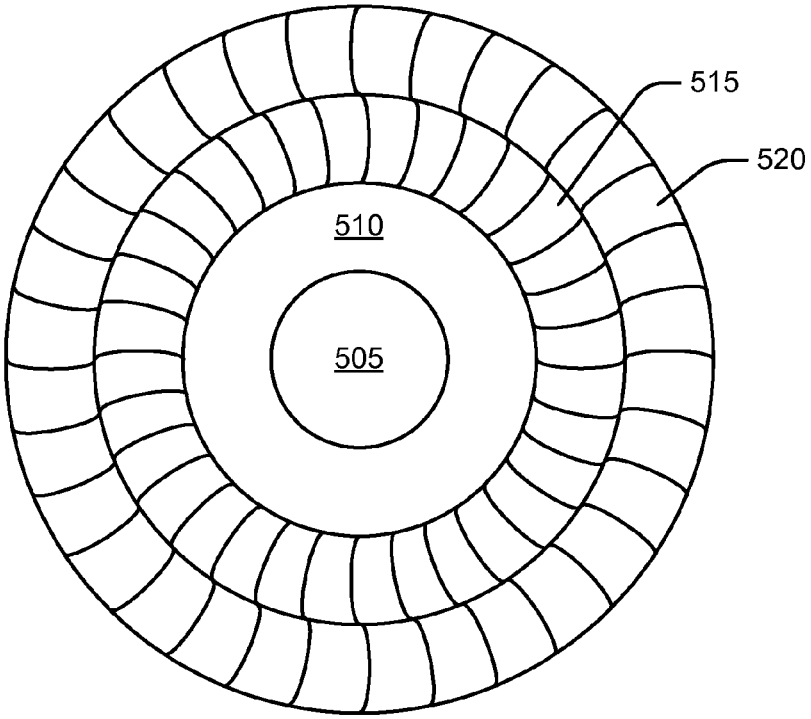

FIGS. 3-5 illustrate a wireline cable with shaped inner and outer armor wires, which when assembled provides a nearly smooth outer surface. In one embodiment, this allows the wireline cable to have a larger outside diameter, which will result in greater effective pull at the cable head. In one embodiment, the smooth cable finish also reduces friction between the cable and the boundary of the aperture 205 and allows for greater sealing and pressure control efficiency. In one embodiment, the configurations shown in FIGS. 3-5 contain more metal in the same outside diameter than traditional wireline cables, which results in greater strength.

One embodiment of a wireline cable 305 includes a conductor package 310. In one embodiment, the conductor package 310 can include any number of conductors of any type. For example, the conductor package can include solid conductors, coaxial conductors, fiber optic conductors, etc. The conductor package can include multi-conductor cables such as seven conductor, crush resistant 7 conductor packages enclosed in a jacket material, single conductor, single fiber optic, fiber optic with one or more conductors, multi-fiber fiber optics, or any other combination. In one embodiment, the conductor package includes strengtheners or load bearing elements to provide strength and stability to the conductor package 310. In one embodiment, the conductors in the conductor package carry electrical power or communications and/or control signals.

In one embodiment, an inner set of armor wires 315 is wrapped around the conductor package 310. Note that only one wire of the inner set of armor wires 315 is shown. The inner set of armor wires is wrapped in a substantially helical pattern. The use of the word helical in this description is not meant to limit the path of the inner set of armor wires 315 to follow the path of a strictly mathematical helical shape. In one embodiment, the path of each wire of the inner set of armor wires 320 deviates but generally follows the mathematical helical pattern.

In one embodiment, an outer set of armor wires 320 is wrapped around the conductor package 310 and the inner set of armor wires 315. Note that only one wire of the outer set of armor wires 320 is shown. The outer set of armor wires is wrapped in a substantially helical pattern. The use of the word helical in this description is not meant to limit the path of the outer set of armor wires 320 to follow the path of a strictly mathematical helical shape. In one embodiment, the path of each wire of the outer set of armor wires 320 deviates but generally follows the mathematical helical pattern.

For the purposes of this application, a helix can be either a right-handed helix or a left-handed helix. For the purposes of this application, a right-handed helical pattern progresses in a clockwise fashion as it recedes from the observer. For the purposes of this application, a left-handed helical pattern progresses in a counter-clockwise fashion as it recedes from the observer.

In one embodiment, the outer set of armor wires 320 generally follows a first-handed helical pattern and the inner set of armor wires 315 generally follows a second-handed helical pattern with the observer positioned at the left side of FIG. 3. In one embodiment, the first-handed helical pattern is a right-handed helical pattern and the second-handed helical pattern is a left-handed helical pattern. In one embodiment, the first-handed helical pattern is a left-handed helical pattern and the second-handed helical pattern is a right-handed helical pattern. In one embodiment, the first-handed helical pattern is a right-handed helical pattern and the second-handed helical pattern is a right-handed helical pattern. In one embodiment, the first-handed helical pattern is a left-handed helical pattern and the second-handed helical pattern is a left-handed helical pattern.

In one embodiment, the shapes of the armor wires are chosen so that when the inner set of armor wires 315 and the outer set of armor wires 320 are laid together, the exterior surface is nearly smooth. In one embodiment, the armor wires are designed without square corners, which means that some voids, albeit smaller as compared to the typical round armor wire design, remain. Once assembled, the design of the armor allows the armor wires to move independently of one another and retain the cable shape upon reforming their original shape if they become temporarily opened or spread apart.

In one embodiment, the inner set of armor wires 315 includes at least some armor wires that have non-circular and non-rectangular cross-sectional shapes. In one embodiment, the outer set of armor wires includes at least some armor wires that have non-circular and non-rectangular cross-sectional shapes. In one embodiment, the inner armor wires that have non-circular and non-rectangular cross-sectional shapes have the same cross-sectional shapes, although, in one embodiment, different in size and orientation, as the outer armor wires with non-circular and non-rectangular cross-sectional shapes.

One embodiment of such a wireline cable, illustrated in cross-section in FIG. 4, includes a conductor package consisting of a single conductor 405 covered by a jacket of insulation 410. The cross-sections of the inner armor wires 415 (only one is designated) have an S shape. The cross-sections of the outer armor wires 420 (only one is designated) also have an S shape, although the S shape is generally the minor image of and larger than the S shape of the inner armor wires.

Another embodiment of such a wireline cable, illustrated in cross-section in FIG. 5, includes a conductor package consisting of a single conductor 505 covered by a jacket of insulation 510. The cross-sections of the inner armor wires 515 (only one is designated) have curved disc shape. The cross-sections of the outer armor wires 520 (only one is designated) also have a curved disc shape, although the curved disc shape is generally the minor image of and larger than the curved disc shape of the inner armor wires.

In one embodiment, the shaping of the armor is done during pulling of the wire to size by pulling the wire through a shaper. In one embodiment, the shaping of the wire is done using a technique designed for nano technology where the wires are shaved to increase the alignment of metal crystals and to improve the metal characteristics and strength resulting in a stronger wireline.

Figure 6:
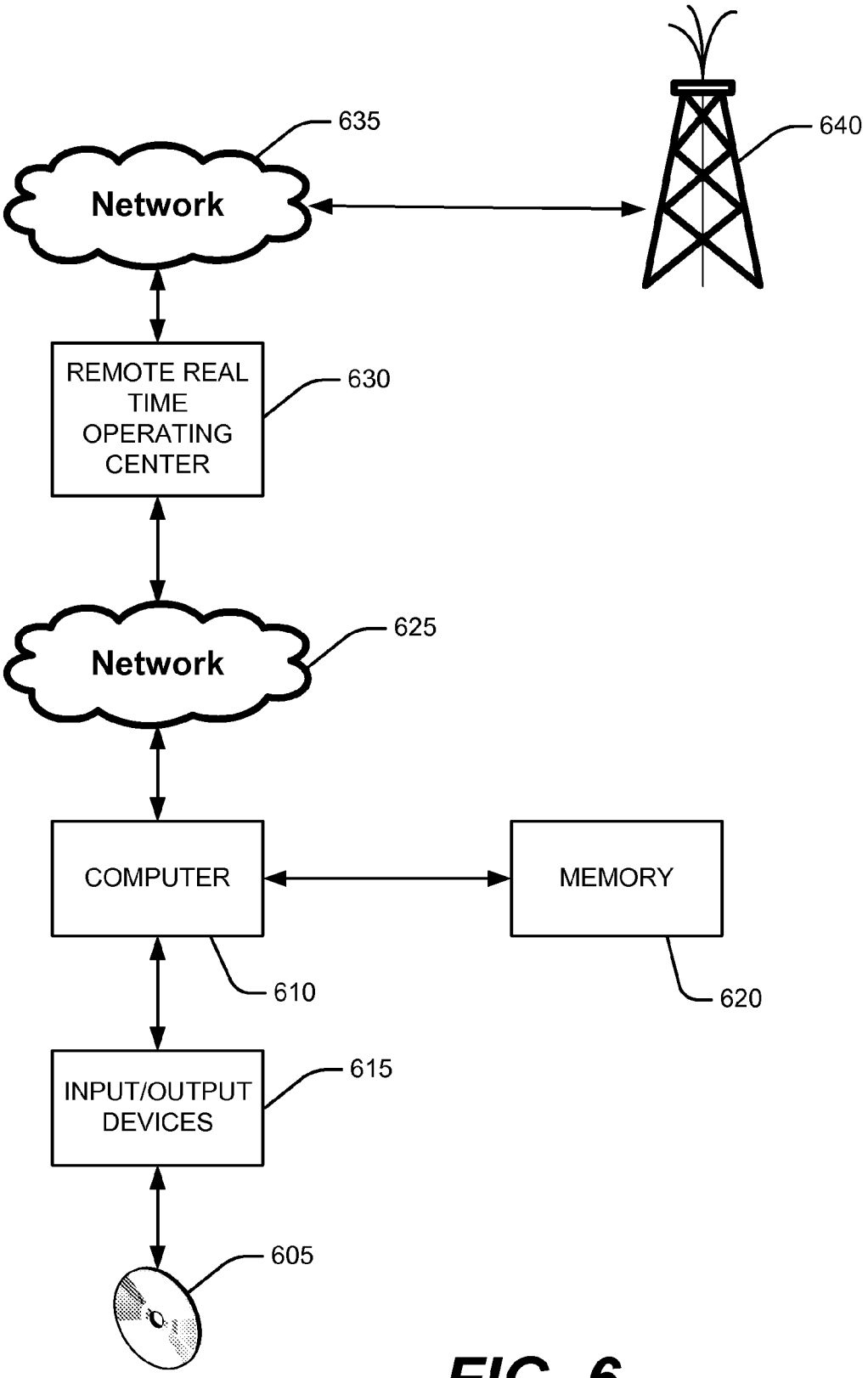
FIG. 6 illustrates a remote real time operating center.

In one embodiment, a computer program for controlling the operation of the wireline logging system 100 is stored on a computer readable media 605, such as a CD or DVD, as shown in FIG. 6. In one embodiment a computer 610, which may be the same as data gather computer 106 or which may be below the surface in the well logging toolstring 116, reads the computer program from the computer readable media 605 through an input/output device 615 and stores it in a memory 620 where it is prepared for execution through compiling and linking, if necessary, and then executed. In one embodiment, the system accepts inputs through an input/output device 615, such as a keyboard, and provides outputs through an input/output device 615, such as a monitor or printer. In one embodiment, the system stores the results of calculations in memory 620 or modifies such calculations that already exist in memory 620.

In one embodiment, the results of calculations that reside in memory 620 are made available through a network 625 to a remote real time operating center 630. In one embodiment, the remote real time operating center 630 makes the results of calculations available through a network 635 to help in the planning of oil wells 640 or in the drilling of oil wells 640. Similarly, in one embodiment, the wireline logging system 100 can be controlled from the remote real time operating center 630.

The word "couple" or "coupling" as used herein shall mean an electrical, electromagnetic, or mechanical connection and a direct or indirect connection.

The cable described herein can also be used in any measurement while drilling ("MWD"), logging while drilling ("LWD"), wired drillpipe, or coiled tubing (wired or unwired) in which a cable is used.

In addition to power being provided from the surface through wireline cable 111, power may also be provided by a battery located in the wireline logging toolstring 116.

The text above describes one or more specific embodiments of a broader invention. The invention also is carried out in a variety of alternate embodiments and thus is not limited to those described here. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

The invention claimed is:

1. A cable comprising:

a conductor at the center of the cable, wherein the conductor extends along a longitudinal axis of the cable;

a plurality of inner armor wires wrapped around the conductor, at least some of the plurality of inner armor wires having non-oval and non-rectangular cross-sectional shapes, wherein the cross-sectional shapes are cross sections perpendicular to the longitudinal axis of the cable; and a plurality of outer armor wires wrapped around the inner armor wires, at least some of the plurality of outer armor wires having non-oval and non-rectangular cross-sectional shapes, wherein the cross-sectional shapes are cross sections perpendicular to the longitudinal axis of the cable.

2. The cable of claim 1 wherein:

the plurality of inner armor wires are wrapped around the conductor in a first-handed helical pattern; and the plurality of outer armor wires are wrapped around the conductor in a second-handed helical pattern.

3. The cable of claim 2 wherein:

the first-handed helical pattern is substantially a right-handed helix; and the second-handed helical pattern is substantially a left-handed helix.

4. The cable of claim 1 wherein:

at least some of the inner armor wires have a serpentine cross-sectional shape, the cross-section being substantially perpendicular to the longitudinal axis of the conductor; and at least some of the outer armor wires have a serpentine cross-sectional shape, the cross-section being substantially perpendicular to the longitudinal axis of the conductor.

5. The cable of claim 4 wherein:

the cross-sectional shape of at least some the inner armor wires is substantially opposite the cross-sectional shape of at least some of the outer armor wires.

6. The cable of claim 1 wherein:

at least some of the inner armor wires have cross-sectional shapes in the form of an S; and at least some of the outer armor wires have cross-sectional shapes in the form of an S.

7. The cable of claim 1 wherein:

at least some of the inner armor wires have cross-sectional shapes in the form of a curved disk; and at least some of the outer armor wires have cross-sectional shapes in the form of a curved disk.

8. A method for constructing a cable comprising:

wrapping a plurality of inner armor wires around a conductor, wherein the conductor extends along a longitudinal axis of the cable, at least some of the plurality of inner armor wires non-oval and non-rectangular cross-sectional shapes, wherein the cross-sectional shapes are cross sections perpendicular to the longitudinal axis of the cable, the conductor being at the center of the cable; and wrapping a plurality of outer armor wires around the inner armor wires, at least some of the plurality of outer armor wires having non-oval and non-rectangular cross-sectional shapes, wherein the cross-sectional shapes are cross sections perpendicular to the longitudinal axis of the cable.

9. The method of claim 8 wherein:

wrapping the plurality of inner armor wires comprises wrapping the plurality of inner armor wires around the conductor in a first-handed helical pattern; and wrapping the plurality of outer armor wires comprising wrapping the plurality of outer armor wires around the conductor in a second-handed helical pattern.

10. The method of claim 9 wherein:

the first-handed helical pattern is substantially a right-handed helix; and the second-handed helical pattern is substantially a left-handed helix.

11. The method of claim 8 wherein:

at least some of the inner armor wires have a serpentine cross-sectional shape, the cross-section being substantially perpendicular to the longitudinal axis of the conductor; and at least some of the outer armor wires have a serpentine cross-sectional shape.

12. The method of claim 11 wherein:

the cross-sectional shape of at least some the inner armor wires is substantially opposite the cross-sectional shape of at least some of the outer armor wires.

13. The method of claim 8 wherein:

at least some of the inner armor wires have cross-sectional shapes in the form of an S; and at least some of the outer armor wires have cross-sectional shapes in the form of an S.

14. The method of claim 8 wherein:

at least some of the inner armor wires have cross-sectional shapes in the form of a curved disk; and at least some of the outer armor wires have cross-sectional shapes in the form of a curved disk.

15. A logging system comprising:

a surface equipment;

a well logging toolstring; and a cable coupling the surface equipment to the well logging toolstring, the cable comprising:

a conductor extending along a longitudinal axis of the cable;

a plurality of inner armor wires wrapped around the conductor, at least some of the plurality of inner armor wires having non-oval and non-rectangular cross-sectional shapes, wherein the cross-sectional shapes are cross sections perpendicular to the longitudinal axis of the cable; and a plurality of outer armor wires wrapped around the inner armor wires, at least some of the plurality of outer armor wires having non-oval and non-rectangular cross-sectional shapes, wherein the cross-sectional shapes are cross sections perpendicular to the longitudinal axis of the cable.

16. The logging system of claim 15 wherein:

the plurality of inner armor wires are wrapped around the conductor in a first-handed helical pattern; and the plurality of outer armor wires are wrapped around the conductor in a second-handed helical pattern.

17. The logging system of claim 16 wherein:

the first-handed helical pattern is substantially a right-handed helix; and the second-handed helical pattern is substantially a left-handed helix.

18. The logging system of claim 15 wherein:

at least some of the inner armor wires have a serpentine cross-sectional shape, the cross-section being substantially perpendicular to the longitudinal axis of the conductor; and at least some of the outer armor wires have a serpentine cross-sectional shape, the cross-section being substantially perpendicular to the longitudinal axis of the conductor.

19. The logging system of claim 15 wherein the logging system is a wireline logging system.

20. The logging system of claim 15 wherein the logging system is selected from the group consisting of a measurement while drilling system and a logging while drilling system.

* * * * *

UNITED STATES PATENT AND TRADEMARK OFFICE

CERTIFICATE OF CORRECTION

PATENT NO. : 8,969,728 B2
APPLICATION NO. : 13/502183
DATED : March 3, 2015
INVENTOR(S) : Daniel F. Dorffer et al.

It is certified that error appears in the above-identified patent and that said Letters Patent is hereby corrected as shown below:

In the Specification

Column 3, line 37, the word “minor” should read -- mirror --.

Column 3, line 46, the word “minor” should read -- mirror --.

Signed and Sealed this
Second Day of June, 2015

Michelle K. Lee

Michelle K. Lee
*Director of the United States Patent and Trademark Office*